US008132495B2

(12) United States Patent
Joynt

(10) Patent No.: US 8,132,495 B2
(45) Date of Patent: Mar. 13, 2012

(54) MULTILAYER ARMOR SYSTEM FOR DEFENDING AGAINST MISSILE-BORNE AND STATIONARY SHAPED CHARGES

(75) Inventor: Vernon P. Joynt, Pretoria (ZA)

(73) Assignee: Force Protection Technologies, Inc., Ladson, SC (US)

( * ) Notice: Subject to any disclaimer, the term of this patent is extended or adjusted under 35 U.S.C. 154(b) by 435 days.

(21) Appl. No.: 12/320,277

(22) Filed: Jan. 22, 2009

(65) Prior Publication Data

US 2011/0067561 A1 Mar. 24, 2011

Related U.S. Application Data

(60) Provisional application No. 61/006,600, filed on Jan. 23, 2008, provisional application No. 61/006,601, filed on Jan. 23, 2008, provisional application No. 61/006,643, filed on Jan. 24, 2008, provisional application No. 61/006,649, filed on Jan. 25, 2008, provisional application No. 61/064,234, filed on Feb. 22, 2008.

(51) Int. Cl.
*F41H 7/02* (2006.01)

(52) U.S. Cl. ..... 89/36.08; 89/36.07; 89/36.09; 89/36.17; 89/902; 89/915; 89/929; 89/930; 89/912

(58) Field of Classification Search ..... 89/36.02, 89/36.04, 36.07, 36.08, 36.09, 36.17, 902, 89/903, 918, 914, 917, 912, 915, 930
See application file for complete search history.

(56) References Cited

U.S. PATENT DOCUMENTS

| | | | |
|---|---|---|---|
| 4,036,104 | A | 7/1977 | Pagano et al. |
| 4,881,448 | A | 11/1989 | Medin et al. |
| 4,934,245 | A | 6/1990 | Musante et al. |
| 5,149,910 | A | 9/1992 | McKee |
| 5,175,040 | A | 12/1992 | Harpell et al. |
| 5,452,641 | A | 9/1995 | Kariya |

(Continued)

OTHER PUBLICATIONS

International Search Report and Written Opinion for PCT/US09/31659 mailed Oct. 30, 2009 (11 pages).

(Continued)

*Primary Examiner* — Michael Carone
*Assistant Examiner* — Daniel Troy
(74) *Attorney, Agent, or Firm* — Finnegan, Henderson, Farabow, Garrett & Dunner LLP

(57) ABSTRACT

An armor system for defeating rocket propelled grenade-type missiles and/or high velocity jets created by shaped charges directed at a vehicle includes a grid layer such as a net and/or an array of slats or bars ("RPG") spaced from an outer surface of the vehicle by support members. The grid layer has a characteristic mesh size or bar/slat spacing to disrupt the missile firing mechanism. The system also has a shaped layer having a plurality of tapered members formed from a fiber-reinforced material, the tapered members positioned between the grid layer and the vehicle outer surface and having respective apex ends proximate the distant the grid layer and base ends, the tapered members defining with adjacent tapered members a plurality of depressions opening in a direction to receive an incoming conical portion of an unexploded RPG-type missile, or a jet emanating from an exploded RPG or other anti-armor device, and a layer of fiber-reinforced material abutting the base ends of the tapered members. The system may further include reactive elements disposed on surfaces of the tapered members defining the depressions to deflect impinging jets. The system may still further include one or more metal armor layers and one or more additional fiber-reinforced material layers disposed between the shaped fiber-reinforced material layer and the vehicle surface.

18 Claims, 9 Drawing Sheets

U.S. PATENT DOCUMENTS

| | | | | |
|---|---|---|---|---|
| 6,021,703 | A * | 2/2000 | Geiss et al. | 89/36.17 |
| 6,216,579 | B1 | 4/2001 | Boos et al. | |
| 6,311,605 | B1 | 11/2001 | Kellner et al. | |
| 7,540,229 | B2 * | 6/2009 | Seo et al. | 89/36.17 |
| 7,866,248 | B2 * | 1/2011 | Moore et al. | 89/36.02 |
| 7,882,776 | B2 * | 2/2011 | Medwell et al. | 89/36.02 |
| 7,908,959 | B2 * | 3/2011 | Pavon | 89/36.17 |
| 2004/0237765 | A1 * | 12/2004 | Schluter et al. | 89/36.17 |
| 2008/0236378 | A1 * | 10/2008 | Sane et al. | 89/36.02 |
| 2010/0288114 | A1 * | 11/2010 | Soukos | 89/36.02 |
| 2010/0294124 | A1 * | 11/2010 | Wentzel | 89/36.02 |

OTHER PUBLICATIONS

Datasheet,Tegris Sheet Stock Technical Data Sheet Jul. 2007, p. 2.

* cited by examiner

MULTILAYER ARMOR SYSTEM FOR DEFENDING AGAINST MISSILE-BORNE AND STATIONARY SHAPED CHARGES

RELATED APPLICATIONS

Priority is claimed to U.S. Provisional Applications No. 61/006,600, filed Jan. 23, 2008; No. 61/006,601, filed Jan. 23, 2008; No. 61/006,643, filed Jan. 24, 2008; No. 61/006,649, filed Jan. 25, 2008; and No. 61/064,234, filed Feb. 22, 2008, the disclosures of each of which being incorporated by reference.

FIELD OF THE INVENTION

The present invention relates to an armor system that is resistant to penetration by high energy solid projectiles and jets of material from hollow charge weapons such as rocket propelled grenades ("RPG's") and stationary shaped charger.

BACKGROUND OF THE INVENTION

Conventional armor such as for protecting vehicles is subjected to a variety of projectiles designed to defeat the armor by either penetrating the armor with a solid or jet-like object or by inducing shock waves in the armor that are reflected in a manner to cause spalling of the armor such that an opening is formed and the penetrator (usually stuck to a portion of the armor) passes through, or an inner layer of the armor spalls and is projected at high velocity without physical penetration of the armor.

Some anti-armor weapons are propelled to the outer surface of the armor where a shaped charge is exploded to form a generally linear "jet" of metal that will penetrate solid armor; these are often called Hollow Charge (HC) weapons. A second type of anti-armor weapon uses a linear, heavy metal penetrator projected at high velocity to penetrate the armor. This type of weapon is referred to as EFP (explosive formed projectile), or SFF (self forming fragment), or a "pie charge," or sometimes a "plate charge."

In some of these weapons the warhead behaves as a hybrid of the HC and the EFP and produces a series of metal penetrators projected in line towards the target. Such a weapon will be referred to herein as a Hybrid warhead. Hybrid warheads behave according to how much "jetting" or HC effect it has and how much of a single big penetrator-like an EFP it produces.

Various projection systems are effective at defeating HC jets. Among different systems the best known are reactive armors that use explosives in the protection layers that detonate on being hit to break up most of the HC jet before it penetrates the target. The problem is that these explosive systems are poor at defeating EFP or Hybrid systems.

Another type of anti-armor weapon propels a relatively large, heavy, generally ball-shaped solid projectile (or a series of multiple projectiles) at high velocity. When the ball-shaped metal projectile(s) hits the armor the impact indices shock waves that reflect in a manner such that a plug-like portion of the armor is sheared from the surrounding material and is projected along the path of the metal projectile(s), with the metal projectile(s) attached thereto. Such an occurrence can, obviously, have very significant detrimental effects on the systems and personnel within a vehicle having its armor defeated in such a manner.

While the HC type weapons involve design features and materials that dictate they be manufactured by an entity having technical expertise, the later type of weapons (EFP and Hybrid) can be constructed from materials readily available in a combat area. For that reason, and the fact such weapons are effective, has proved troublesome to vehicles using conventional armor.

The penetration performance for the three mentioned types of warheads is normally described as the ability to penetrate a solid amount of RHA (Rolled Homogeneous Armor) steel armor. Performances typical for the weapon types are: HC warheads may penetrate 1 to 3 ft thickness of RHA, EFP warheads may penetrate 1 to 6 inches of RHA, and Hybrids warheads may penetrate 2 to 12 inches thick RHA. These estimates are based on the warheads weighing less than 15 lbs and fired at their best respective optimum stand off distances. The diameter of the holes made through the first inch of RHA would be; HC up to an inch diameter hole, EFP up to a 9 inch diameter hole, and Hybrids somewhere in between. The best respective optimum stand off distances for the different charges are: standoff distances for an HC charge is good under 3 feet but at 10 ft or more it is very poor; for an EFP charge a stand off distance up to 30 feet produces almost the same (good) penetration and will only fall off significantly at very large distances like 50 yards; and for Hybrid charges penetration is good at standoff distances up to 10 ft but after 20 feet penetration starts falling off significantly. The way these charges are used are determined by these stand off distances and the manner in which their effectiveness is optimized (e.g., the angles of the trajectory of the penetrator to the armor). These factors effect the design of the protection armor.

Conventional armor is subjected to a variety of projectiles designed to defeat the armor by penetrating the armor. Some anti-armor weapons are propelled to the outer surface of the armor where a shaped charge is exploded to form a generally linear "jet" of metal that will penetrate solid armor. Such weapons are often called Hollow Charge (HC) weapons. A rocket propelled grenade ("RPG") is such a weapon. An RPG 7 is a Russian origin weapon that produces a penetrating metal jet, the tip of which hits the target at about 8000 m/s. When encountering jets at such velocities solid metal armors behave more like liquids than solids. Irrespective of their strength, they are displaced radially and the jet penetrates the armor.

Various protection systems are effective at defeating HC jets. Among different systems the best known are reactive armors that use explosives in the projection layers that detonate on being hit to break up most of the HC jet before it penetrates the target. Also known are "bulging armor" components which upon impact by the jet, distort into the jet path to deflect or break up the jet to some extent. Both such systems are often augmented by what is termed "slat armor," a plurality of metal slats or bars disposed outside the body of the vehicle to prevent the firing circuit for an RPG from functioning.

Also, as recently disclosed by the Foster-Miller company as part of its RPG Net™ Defense Systems, a net suspended alongside and spaced from the surface of an armored vehicle can act to disrupt RPGs by breaking and/or defeating the RPGs. These nets are reported to be able to crush the foreword conical surface of the RPG 7 to render the fuze inoperative and thereby prevent detonation and shaped charge formation in a significant percentage of RPG 7 impacts.

While any anti-armor projectile can be defeated by metal armor of sufficient strength and thickness, extra metal armor thickness is heavy and expensive, adds weight to any armored vehicle using it which, in turn, places greater strain on the vehicle engine, and drive train.

Armor solutions that offer a weight advantage against these types of weapons can be measured in how much weight of RHA it saves when compared with the RHA needed to stop a particular weapon penetrating. This advantage can be calculated as a protection ratio, the ratio being equal to the weight of RHA required to stop the weapon penetrating, divided by the weight of the proposed armor system that will stop the same weapon. Such weights are calculated per unit frontal area presented in the direction of the anticipated trajectory of the weapon.

Thus, there exists a need for an armor system that can defeat projectiles and jets from anti-armor devices, particularly rocket propelled grenades, without requiring an excess thickness of metal armor. Preferably, such an armor system would be made of materials that can be readily fabricated and incorporated into a vehicle design at a reasonable cost, and even more preferably, can be added to existing vehicles.

As the threats against armored vehicles increase and become more diverse, combinations of armor systems are needed to defeat the various threats. An armor system that raises the protection level of an armored vehicle to include HC charges, both missile-borne and stationary, is described.

SUMMARY OF THE INVENTION

Additional objects and advantages of the invention will be set forth in part in the description which follows, and in part will be obvious from the description, or may be learned by practice of the invention. Some or all of the objects and advantages of the invention will be realized and attained by means of the elements and combinations particularly pointed out in the appended claims.

In accordance with a first aspect of the present invention, there is disclosed an armor system for defeating missile-borne and stationary shaped charges directed against a vehicle, the missile having a forward conical component and a tip-mounted electric fuze, the vehicle having a hull with outer and inner surfaces. The armor system includes a grid layer located outside of, and spaced away from, the outer surface of the armored vehicle, the grid layer having grid members separated one from the other a distance disposed to engage and disrupt the electrical firing mechanism of the tip-mounted fuze. The armor system further includes a shaped layer having plurality of tapered members formed of a fiber-reinforced material between the grid layer and the outer surface of the vehicle defining depressions configured to receive the forward conical portion of an unexploded missile and to attenuate a high velocity jet emanating from an exploded missile and/or a stationary shaped charge.

In accordance with a second aspect of the present invention, there is disclosed an armor system for defeating a rocket propelled grenade directed at a vehicle, the vehicle having a hull with outer and inner surfaces, the rocket propelled grenade of the type having a forward conical section and a tip-mounted piezoelectric fuze component. The armor system includes a net layer having a plurality of cord members spaced from the outer surface of the vehicle by support members, and a shaped layer having plurality of tapered members formed from a fiber-reinforced material and a layer of fiber-reinforced material abutting the base ends of the tapered members. The tapered members are positioned between the net layer and the vehicle outer surface and have respective apex ends proximate the net layer and opposite base ends, the tapered members defining with adjacent tapered members a plurality of depressions opening in a direction away from the vehicle outer surface. A mesh size of the net layer is selected to allow passage of the fuze component and to engage and deform the conical section of the missile to short-circuit the fuze component. The armor system further includes bulging-type reactive elements disposed on surfaces of the tapered members defining the depressions.

In accordance with a third aspect of the present invention, there is disclosed a method of defeating missile-borne and stationary shaped charges directed at a vehicle, the missile of the type having a conical forward portion, relative to its trajectory, and a tip-mounted electric fuze component, the vehicle having a hull with an outer surface. The method includes the steps of interposing a grid layer comprised of a net or spaced bar/slat configuration in the missile trajectory spaced from the outer surface of a vehicle, the grid layer having a grid mesh size to engage the conical section to short circuit the fuze on a missile not detonating on the grid layer; interposing a shaped fiber-reinforced material layer downstream of the grid layer relative to the trajectory, the shaped fiber-reinforced layer having depressions therein and bulging armor with metal plates disposed on the surfaces forming the depressions, the depressions configured such that a jet formed by a missile detonating on the grid layer next encounters the bulging armor and the shaped layer material; moving the metal plates of the bulging armor obliquely into the path of the jet by a reaction of the impinging jet; deflecting the jet with the metal plates moved into its path; and attenuating the deflected jet in the fiber-reinforced materials of the shaped layer.

Preferably, the armor systems also include one or more metal layers and/or one or more additional fiber-reinforced material layers disposed between the shaped fiber-reinforced material layer and the vehicle outer surface.

In embodiments of the invention the fiber in the fiber-reinforced material may consist essentially of a material selected from the group consisting of: poly-paraphenylene terephthalamide, stretch-oriented high density polyethylene, stretch-oriented high density polypropylene, stretch-oriented high density polyester, a polymer based on pyridobisimidazole, and silicate glass. Presently preferred embodiments of the invention include fiber-reinforced materials having high density stretch-oriented polypropylene fibers consolidated by heat and pressure in a lower density polypropylene polymer.

The accompanying drawings, which are incorporated in and constitute a part of this specification, illustrate several embodiments of the invention and together with the description, serve to explain the principles of the invention.

DESCRIPTION OF THE DISCLOSED EMBODIMENTS

Reference will now be made in detail to embodiments of the invention, examples of which are illustrated in the accompanying drawings. Wherever possible, the same reference numbers will be used throughout the drawings to refer to the same or like parts.

In accordance with the invention, there is provided an armor system for defeating a range of anti-armor weapons. While the invention and its embodiments may impede penetration of relatively non-elongated, heavy, solid metal projectiles formed and propelled by either manufactured explosive devices or improvised explosive device, its primary utility is to defeat devices generating elongated metal "jets," produced by shaped charges whether missile borne or stationary, along with the heavy solid projectiles.

The parameters of the system can be selected to defeat a particular projectile if its weight, density, velocity, and size are known. The parameters of the system are the mechanical properties (ultimate tensile strength, hardness, elastic modulus, fracture toughness, and velocity of forced shock) of the layers of material comprising the layers of the invention, the spacing of the layers (the distance between layers, i.e. the thickness of the dispersion space) and the nature of any materials placed in the space between the layers.

Where the system contains a layer of fibrous material it attenuates the energy of the penetrating material by resisting the enlargement of an opening therein by virtue of the extremely high tensile strengths of the fibers comprising the fibrous sheet. Even if penetrated by an elongated penetrator, the initial opening resists enlargement and exerts high shear forces on the lateral surfaces of the elongated penetrator. This slows the penetrator and reduces the energy in the penetrator. This increases the probability that the next layer in the armor system will either defeat the penetrator, or further slow the penetrator such that layers of the system that will encounter the penetrator may have a better chance of defeating it.

Figure 9:
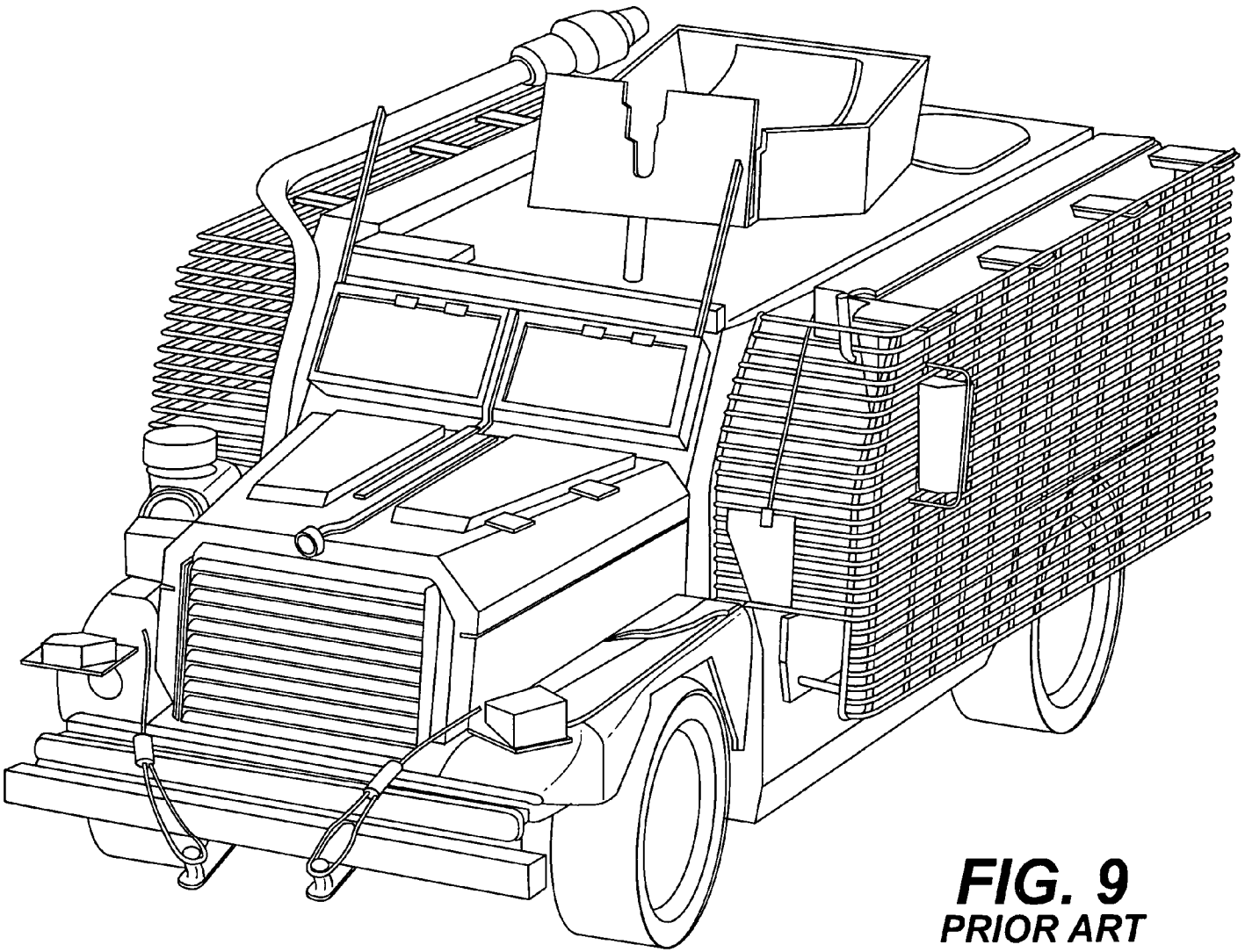
FIG. 9 PRIOR ART
FIG. 9 is a photograph of a vehicle that includes conventional slat armor.

In accordance with an aspect the present invention there may be provided a plurality of rigid members located outside of and spaced from the outer surface of a vehicle. An array of rigid members configured as slats elongated in the direction parallel to a vehicle surface that are suitable for use in the armor system is conventionally called "slat armor," and a vehicle using such armor is depicted in FIG. 9. In a first aspect of the present invention, the "slat armor" is used as a support for the net-type grid layer to be discussed henceforth in relation to FIGS. 1-5. However, in another aspect of the present invention to be discussed later in relation for FIGS. 6 and 7, the "slat armor" can itself comprise the grid layer, to be used in conjunction with the shaped layer of fiber-reinforced tapered members, and preferably with other armor layers, between the grid layer and the vehicle hull outer surface. The present invention thus improves the performance of existing types of slat armor and provides a layered armor system which includes tapered members of a fiber-reinforced material configured in a shaped layer, and which may further include reactive armor elements (all to be discussed hereinafter), integrated with the slat armor.

Figure 1:
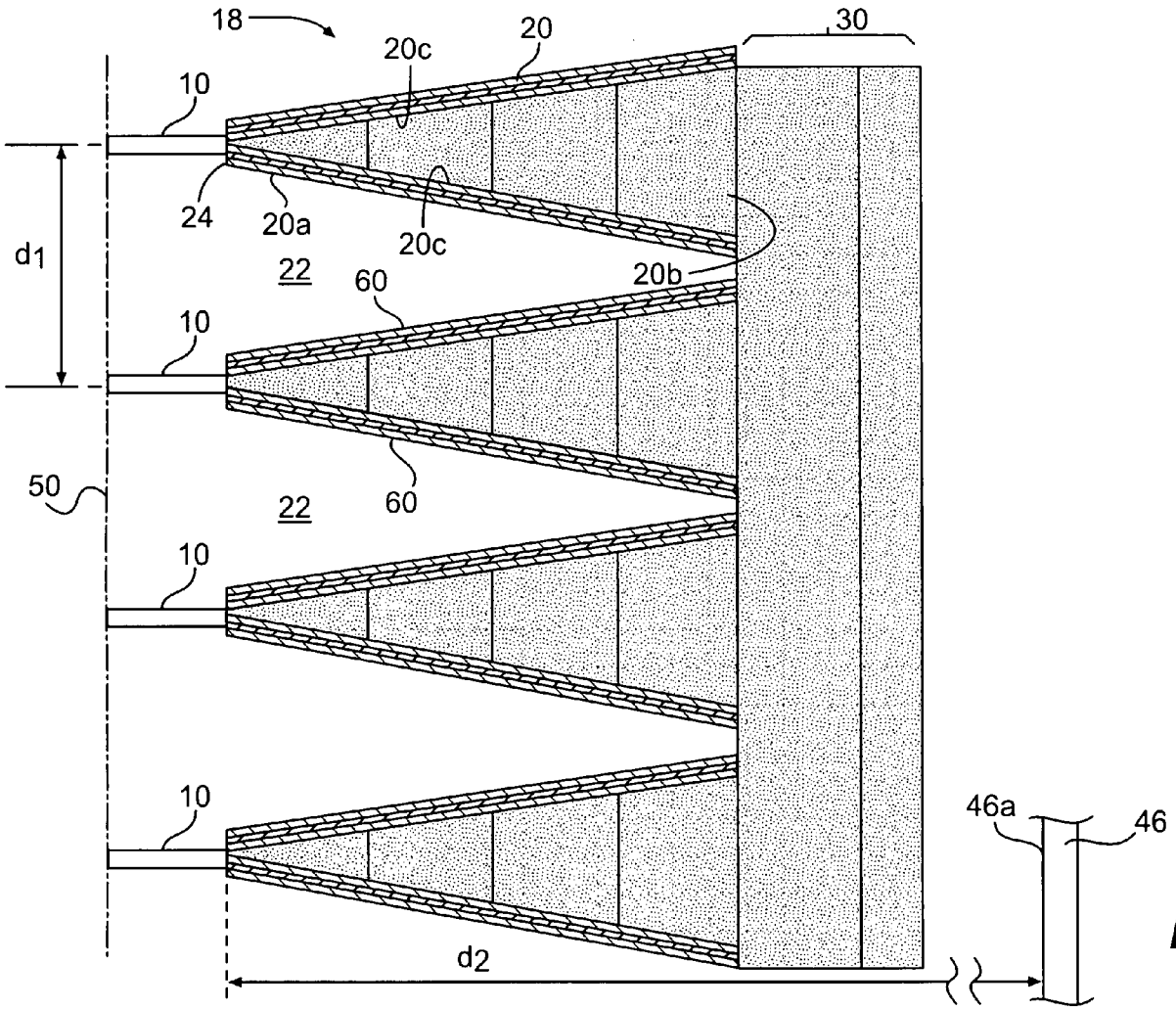
FIG. 1 is a schematic, cross-sectional view of an outer portion of a first embodiment of the disclosed armor system illustrating the configuration of the depressions in shaped layer formed by tapered members of a fiber-reinforced material downstream of a section of a net layer supported by "slat" armor, relative to a trajectory of a missile or jet.
Figure 2:
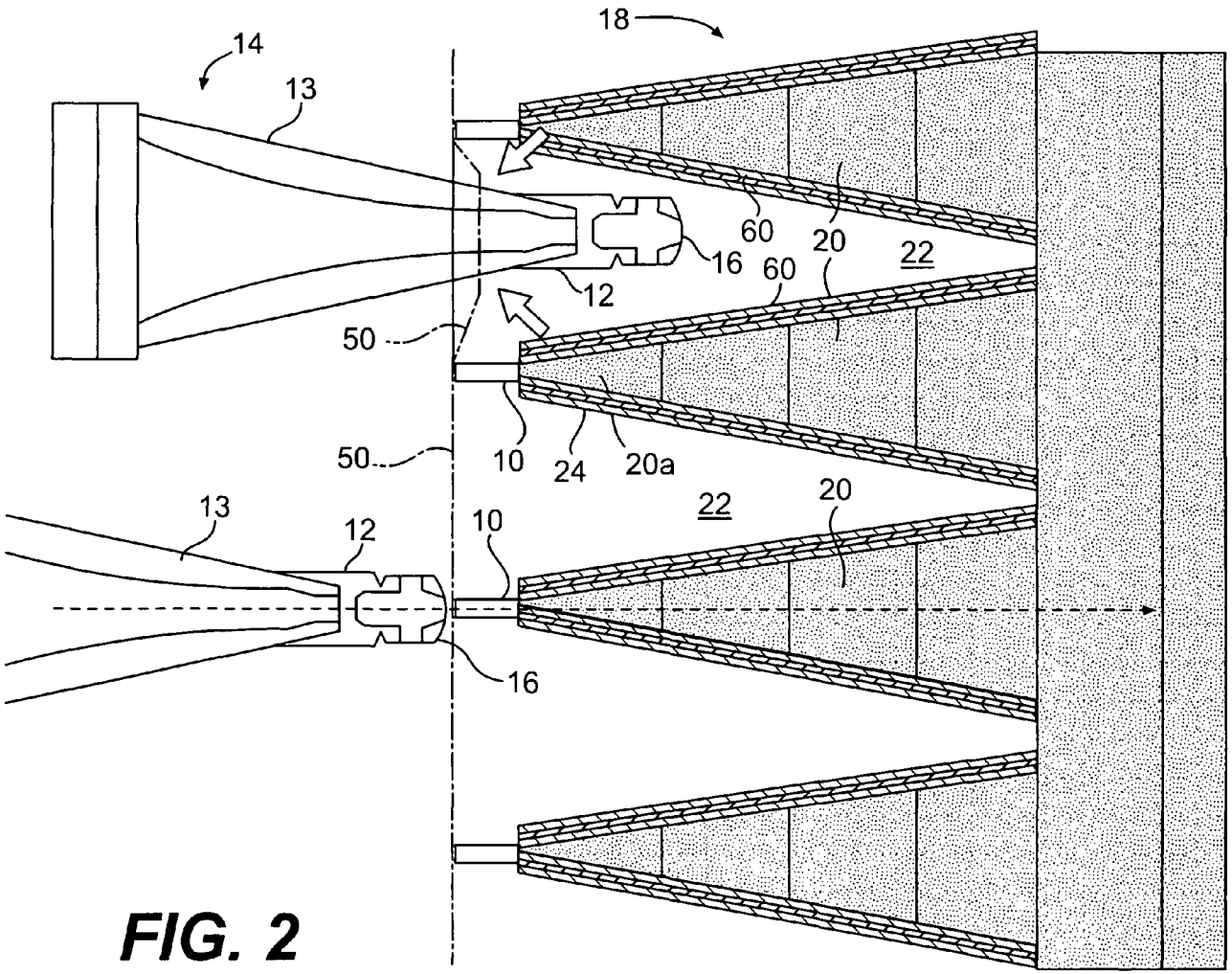
FIG. 2 is a schematic, cross-sectional view depicting performance of the armor system outer portion shown in FIG. 1, with incident RPG-type missile warheads having conventional piezoelectric fuzes.

As depicted schematically in FIGS. 1 and 2, the slats 10 are elongated members separated one from the other along their length by a distance $d_1$, and spaced a distance $d_2$ from the outer surface 46*a* of vehicle hull 46. The individual slats 10, which typically are formed from mild steel and have cross-sectional dimensions of about 10 mm×50 mm, could be replaced by elongated bars of a rectangular or round cross-section, but slats may be preferred as they have a better stiffness to weight ratio for the same material and cross sectional dimension. As shown in FIG. 2 the distance $d_1$ between each adjacent slat 10 may be configured to allow the tip 12 of forward conical section 13 of a missile such as RPG 7 to pass between the slats 10. The fuze mechanism of certain types of RPGs such as the RPG 7 includes a piezoelectric element 16 located at tip 12 that generates an electric pulse that is conducted to the rearwardly located fuze component (not shown) through the conical portion 13 of the RPG. When the conical section 13 of the RPG is crushed or deformed by the slats 10, the electric pulse generated by the piezoelectric element of the firing mechanism is electrically short-circuited or otherwise prevented from reaching the rear fuze component, and the RPG warhead (the shaped charge that creates the jet) does not detonate.

Approximately 60% of the RPG 7s having piezoelectric fuze components that impact conventional slat armor (e.g. as shown in FIG. 9) do not detonate because the tip and fuze pass between two adjacent slats which "pinch" or crush the trailing conical section and disrupt the firing circuit. If the slats are too close, the probability of the RPG detonating on a slat increases, and if the slats are too far apart the RPG round will pass between the slats without being short circuited and detonate on the armor surface. Slat-slat spacings of about 68 mm have typically been used in conventional slat armor systems, but the spacing may be substantially increased in the presently disclosed system due to the net-type grid layer to be discussed below. The remaining 40% of the RPG rounds hit a slat and detonate. In most conventional slat armor systems the space behind the slats that must accommodate the length of the conical portion and tip-mounted fuze component without activating the fuze, is empty. Typically the slats are supported from the vehicle by side support members (see FIG. 9) to achieve a stand-off distance of about 275 mm.

In accordance with the invention, a layer of netting is positioned in front of and covering the rigid members. The net layer may be configured to be supported by the rigid members against deflection toward the vehicle surface. Conventional mechanical fasteners may be used for attaching the net to the rigid member supports, to provide both axial (toward the vehicle body surface) as well as lateral (parallel to the body surface) restraints on the net.

An embodied herein, and as depicted schematically in FIGS. 1-5, layer 50 of a net material is positioned to cover, and be supported by, slats 10. The net layer is intended to provide essentially the same function as the conventional slat armor, that is, to laterally crush or otherwise deform the conical tip portion of an RPG to disable and/or short circuit the fuze, the mesh or grid size of net 50 may be made smaller than the spacing between the rigid members, namely slats 10 in FIGS. 1-5. Moreover, the mesh size may be selected in view of the dimensions of the RPG type(s) expected in the battle theater. It is presently contemplated that mesh sizes of about 1"-3" may be useful, with the smaller mesh sizes used with existing slat armor (slat-slat spacing of about 68 mm). The larger mesh sizes may be useful when the rigid members are spaced apart by distances $d_1$ greater than conventional separation distances, that is, when the rigid members are intended to provide primarily a support function for net 50, and not provide a back-up intercept and crush function. Also, conventional mechanical fasteners (pins, bolts/washers, rivets, screws/washers, etc.) may be used to attach net layer 50 to the rigid member supports, and may allow the net layer component to be readily replaced if different RPG types with different conical tip sizes are encountered or the net is damaged.

The net layer 50 may be formed from high strength, low stretch material such as Zytel®, a nylon material available from DuPont. Other net materials may be used including metal mesh fabricated from e.g., conventional braided steel cable of about ⅛" diameter. The higher weights for metal-based nets may be acceptable, because a metal mesh may be more durable and less prone to cutting. In either case, the crossing strands of the net material may be welded or otherwise bonded together at the crossing points to resist enlargement of the mesh openings by the RPG 7 conical section.

In accordance with the invention, a shaped layer comprising tapered members formed from a fiber-reinforced material are placed between the rigid members and the outer surface of the vehicle. The adjacent tapered members define cavities or depressions configured to receive the forward conical portion of a rocket propelled grenade before fuze contact can occur. As here embodied and depicted in FIGS. 1 and 2, the system includes shaped layer 18 having tapered members 20 with sides 20*c* defining depressions 22 disposed to receive the conical section 13 of the RPG 7 including tip 12 with fuze component 16. In FIG. 1, tapered members are configured in a wedge-shape and aligned with a respective slat 10 in a direction generally perpendicular to the vehicle surface, each with an apex 20*a* abutting a rear edge 24 of slat 10. However, armor system configurations having some tapered members 20 not aligned with a respective rigid member are specifically contemplated. See discussion of the embodiment in FIG. 8, below. In such configurations, all the tapered members and resulting depressions would nevertheless be covered by the net layer.

If an RPG round hits a slat 10 and detonates, the fiber-reinforced material in the shaped layer 18 behind the slat attenuates the jet and increases the probability that the total armor system, including metal layers and fiber-reinforced material layers to be discussed hereinafter, will survive the challenge of the jet and the vehicle receiving the RPG hit will not be breached, or the severity of the breach will be significantly reduced.

The length dimensions of tapered members 20 may be conservatively set to receive the full length of conical portion 13 of the specific RPG type of concern (typically 8 inches for an RPG 7). Also, the bases 20*b* of adjacent tapered members 20 may be separated as depicted in FIG. 1 to accommodate the width of a forward-mounted RPF fuze element, without contact with sides 20*c* such as about 20 mm, the diameter of the piezoelectric fuze component in RPG 7s. However, if the net layer 50 is configured with a mesh size less than the rigid member spacing (i.e., the spacing between slats 10 in FIG. 1), the length dimensions of tapered members 20 may be reduced, as crushing (and fuze disablement) engagement of conical section 13 by the net layer may occur at a location closer to tip 12. This reduction in tapered member length may result in a more "compact" armor system, or the ability to use more or thicker layers of fiber-reinforced material and/or sheet type metal armor between the tapered members 20 and the vehicle hull 46, as discussed in more detail below.

It is believed that the fiber-reinforced material of shaped layer 18 attenuates the energy of the penetrating jet following impact on a slat (see FIG. 2, lower portion) by resisting the enlargement of an opening therein by virtue of the extremely high tensile strengths of the fibers comprising the fibrous material. Even if penetrated, the initial opening resists enlargement and exerts high shear forces on the lateral surfaces of the penetrating jet material. This increases the probability that subsequent layers in the armor system will either defeat the jet before it engages the vehicle hull, or slow it such that layers interior to the hull that will encounter the jet may have a better chance of defeating it.

The fiber-reinforced material may be comprised of a plurality of fibers having an ultimate tensile strength greater than 2.5 GPa bonded to form the sheet by a polymer surrounding the fibers. Without being bound by theory, it is believed that any jet of material penetrating the fibrous layer must separate the fibers laterally and hence apply a tensile load on the fibers. When the fibers are sufficiently strong (have a high tensile strength), the material surrounding the jet constricts the jet and slows it substantially. Because the jet defeats armor by the inertia of an elongated (explosive formed) molten metal penetrator, the reduction of the velocity of the jet significantly reduces its effectiveness. Hence, due to jet attenuation by the tapered member 20 formed of such fiber-reinforced material the subsequent layers in the armor system of the present invention can more readily defeat the jet.

Recent developments in fiber technology have created fibers having tensile strengths in relatively light materials that are in excess of 3 GPa. In a preferred embodiment, the fiber in the fiber-reinforced sheet armor consists essentially of a material selected from the group consisting of: poly-paraphenylene terephthalamide, stretch-oriented high density polyethylene, stretch-oriented high density polypropylene, stretch-oriented high density polyester, a polymer based on pyridobisimidzole, and silicate glass.

Preferably the fiber-reinforced material consists essentially of stretch-oriented, high molecular weight polyethylenes, especially linear polyethylenes, having an ultrahigh molecular weight of 600,000 to 6,000,000 g/mol and higher. Such fibers are bound together such as with a polymer matrix by heat and pressure to form a sheet-like product with polymeric matrix materials, for example thermosetting resins such as phenolic resins, epoxy resins, vinyl ester resins, polyester resins, acrylate resins and the like, or polar thermoplastic matrix materials such as polymethyl (meth)acrylate. A particularly preferred fiber-reinforced sheet armor of this type is known commercially as Dyneema®, a product of DSM Dyneema, Mauritslaan 49, Urmond, P.O. Box 1163, 6160 BD Geleen, the Netherlands.

Another preferred fiber-reinforced material consists essentially of a composite made of high molecular weight polypropylene. In such a product, tape yarn of high molecular weight stretch-oriented polypropylene is woven into a fabric. Multiple layers of fabric are stacked and consolidated with heat and pressure to form rigid sheets using low molecular weight polypropylene as a matrix. A particularly preferred fiber-reinforced sheet armor made of this type material is known commercially as Tegris®, a product of Milliken & Company, 920 Milliken Road, P.O. Box 1926, Spartansburg, S.C., 29303 USA. Such a material is described in U.S. Pat. No.

7,300,691 to Callaway et al., the content of which is specifically incorporated by reference herein.

Preferably, shaped layer 18 includes at least one continuous sheet of the fiber-reinforced material abutting the bases of the tapered members. As here embodied, and as depicted in FIGS. 1-5, sheet 30 of fiber-reinforced material abuts bases 20*b* of tapered members 20. Sheet 30 may consist essentially of the same material as that used in the tapered members 20. The fiber-reinforced materials disclosed to be used in the tapered members 20 can be used in sheet 30 and those materials provide similar benefits with respect to impeding projectiles and jets as are provided when used in tapered members 20. The thickness of fiber-reinforced material sheet 30 in the embodiments in FIGS. 1-5 may be about 3".

The wedge-shaped tapered members 20 depicted in FIG. 1 may be formed from stacked layers of sheets of the fiber-reinforced material. The cavities/depressions 22 can be formed by stacking different width sheets cut at an angle (e.g. about 7° in the FIG. 1 embodiment). While the embodiment depicted shows fiber-reinforced material sheets laminated to form tapered members 20 and a sheet-like layer of fiber-reinforced material 30 abutted thereto, these elements alternatively may be combined into a unitary shaped layer with depressions 22 and no interface between the members forming the depressions (shown here as 20) and the rear portion (shown here as sheet 30).

Figure 4:
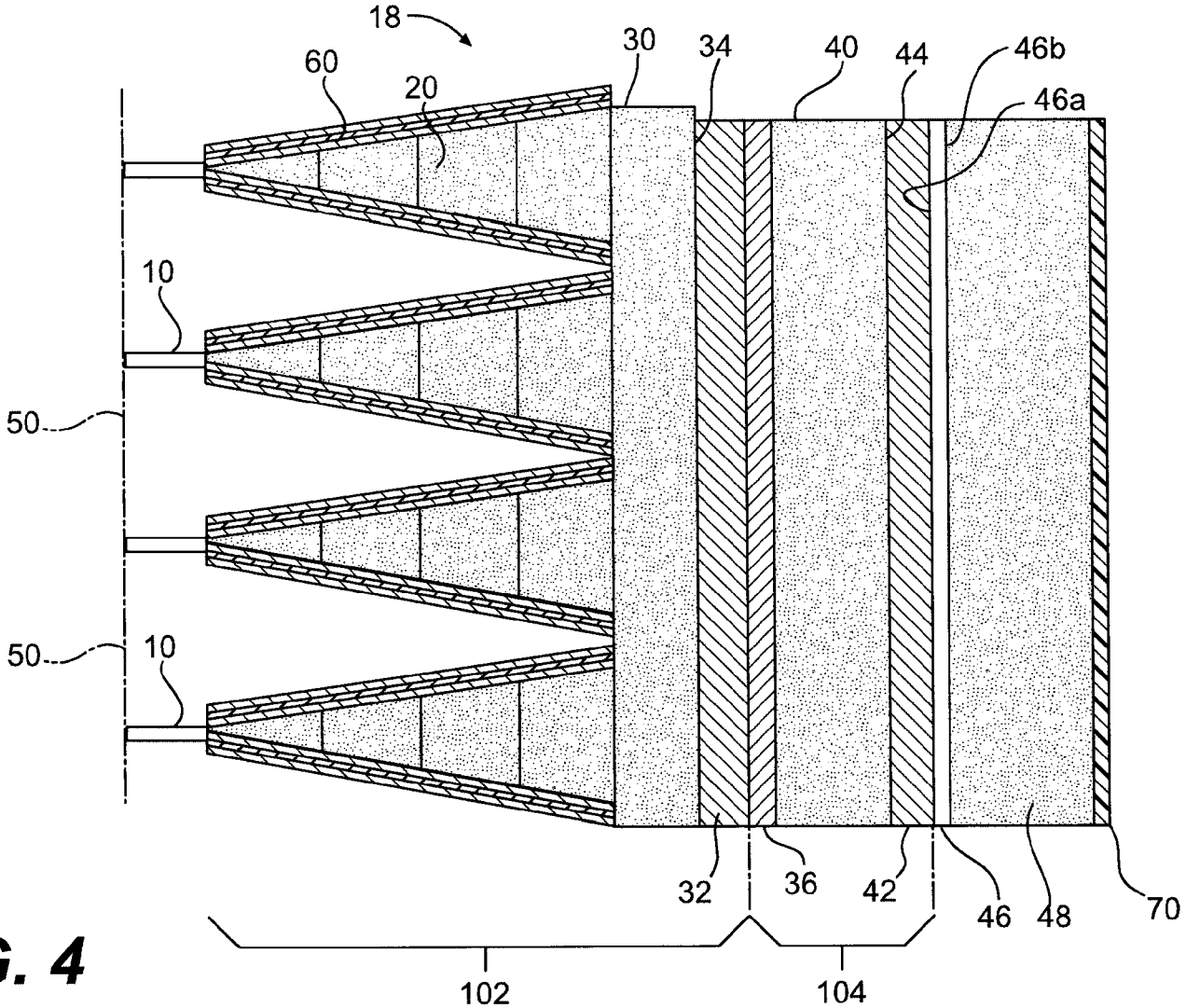
FIG. 4 is a schematic, cross-sectional view of the entire first embodiment of the disclosed armor system of FIG. 1, shown in relation to a vehicle hull.
Figure 5:
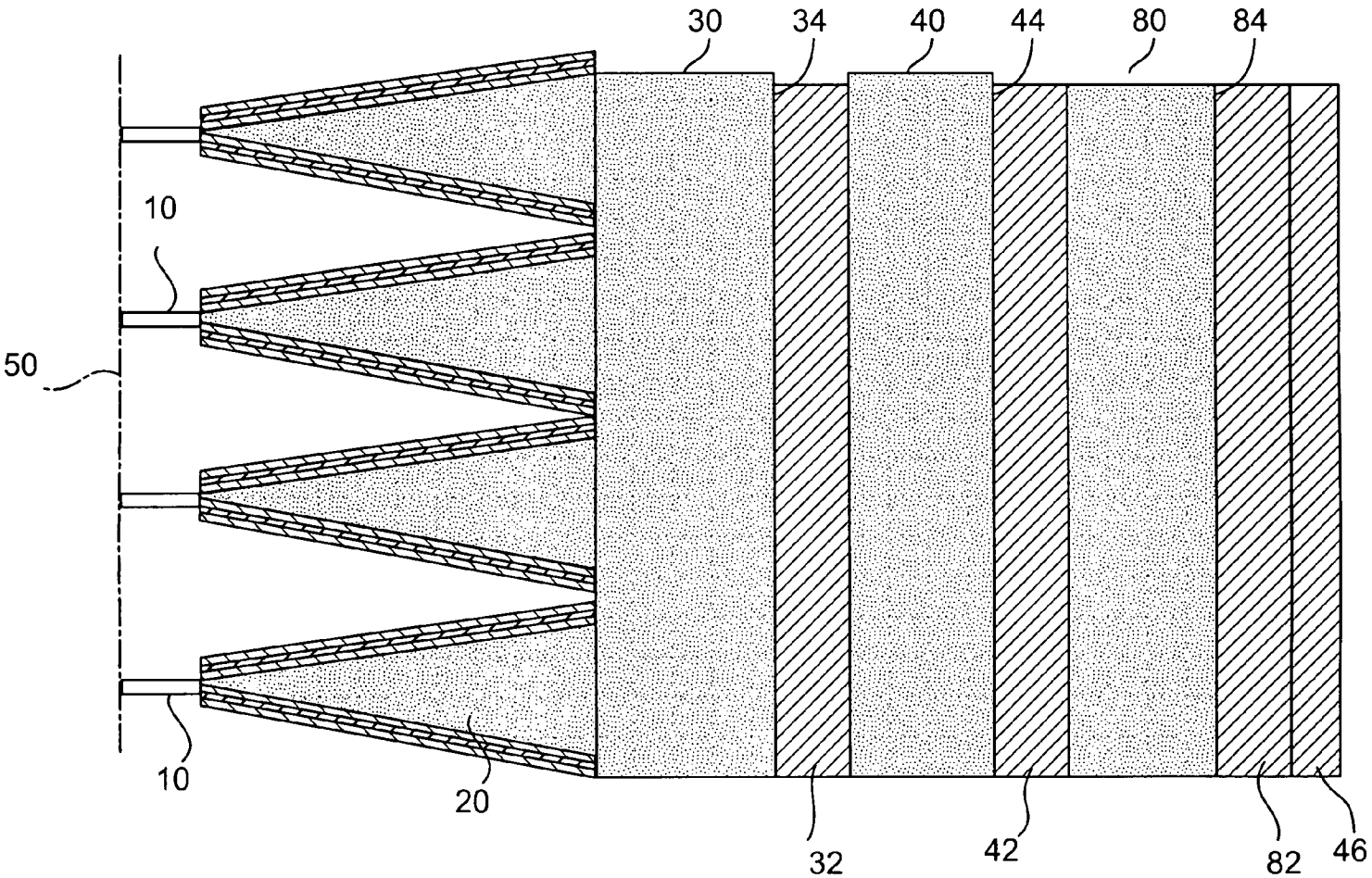
FIG. 5 is a schematic cross-sectional view of a second embodiment of the disclosed armor system shown in relation to a vehicle hull.
Figure 6:
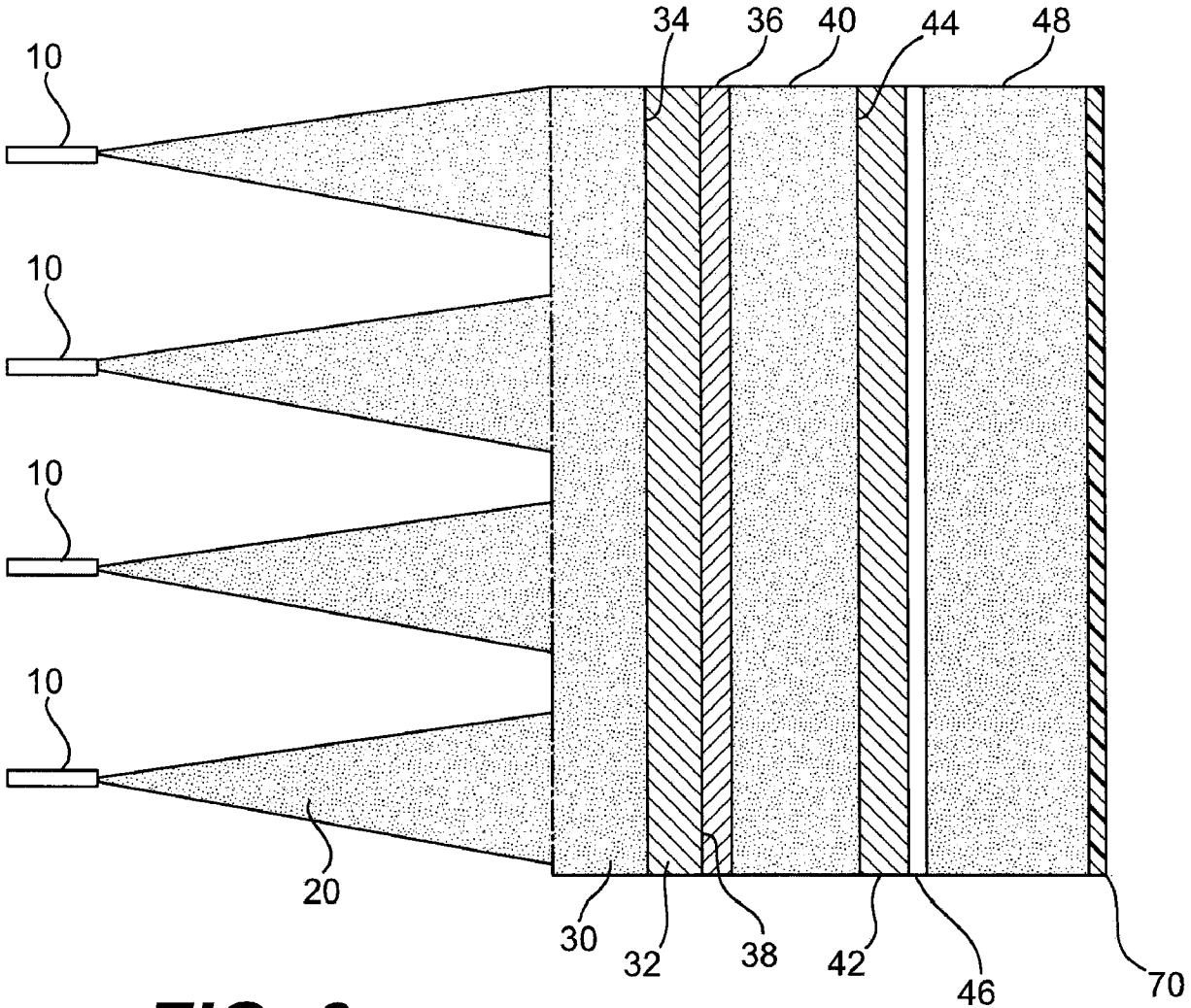
FIG. 6 is a schematic cross-sectional view of a third embodiment of the disclosed armor system where slat armor constitutes the grid layer and wherein fiber-reinforced material layers and layers of sheet metal armor are disposed behind the shaped layer.
Figure 7:
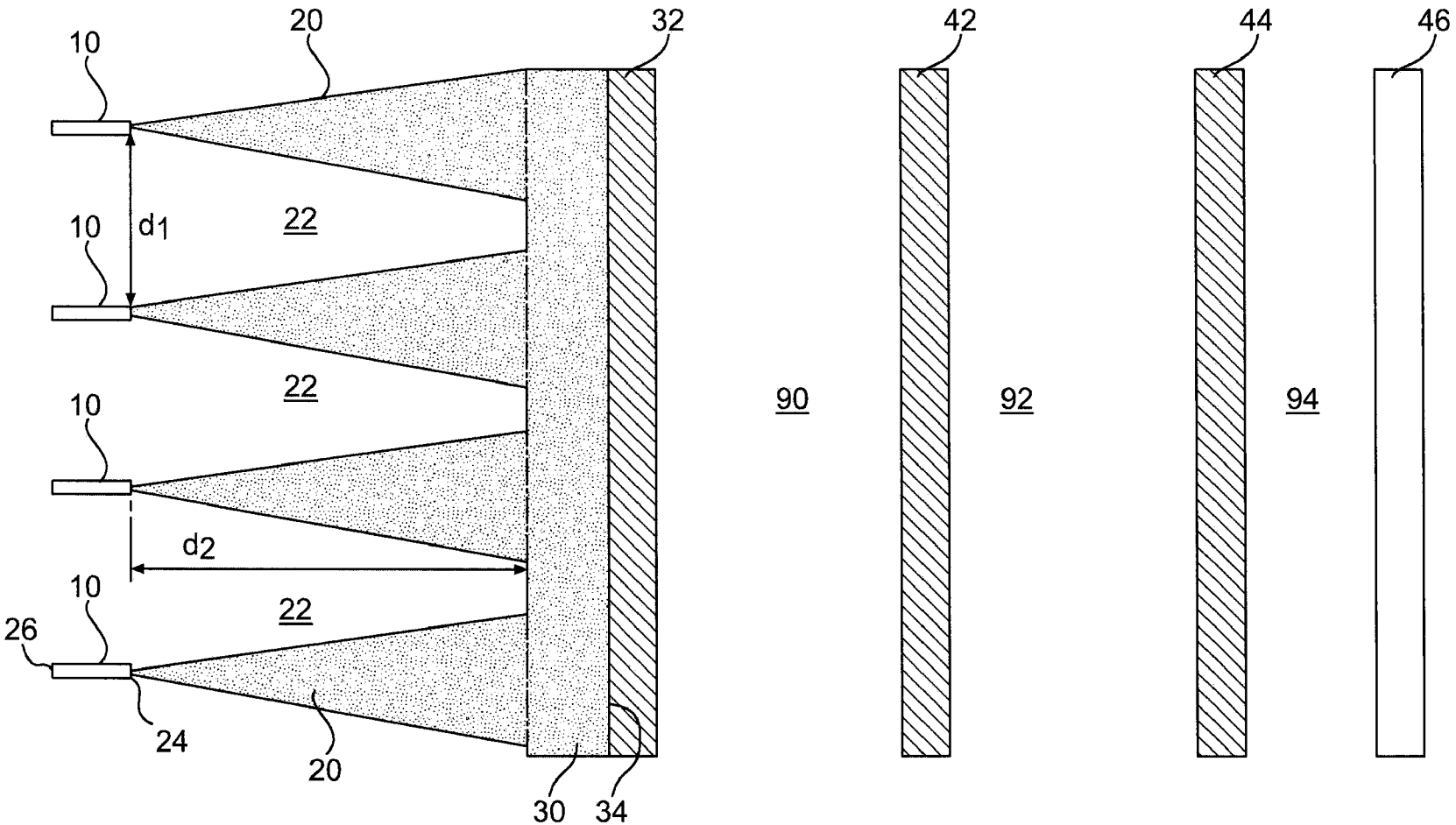
FIG. 7 is a schematic cross-sectional view of the outer portion of a fourth embodiment where the slat armor constitutes the grid layer and wherein multiple layers of metal armor separated by dispersion spaces are disposed behind the shaped layer.

Because multi-layer armor embodiments for protecting against EFP penetrators work better against slower penetrators (e.g. about 2000 m/s or less) than against faster penetrators like about 2500 m/s and above, lower density materials can be used to slow the penetrator rather than metallic layers with spacings towards the rear of the assemblies, where those materials and spacings work better e.g. such as in the embodiment depicted in FIG. 7 and also in FIG. 4, FIG. 5, and FIG. 6. Suitable "tough" (high elongation of fracture) titanium alloys may be used for the metal armor layers of the present invention, as well.

Still further in accordance with the present invention, the armor system may include reactive elements positioned on the surfaces of the adjacent tapered elements that form the depressions. As embodied herein, and with reference again to FIG. 1, reactive elements 60 are positioned on the side surfaces 20*c* of tapered members 20. Each element 60 is a "bulging armor" type reactive element, which may comprise a layer of a rubber material sandwiched between two metal plates as depicted in FIG. 1. The plates may be mild steel plates each of about 2 mm in thickness, and the rubber layer about 1 mm in thickness. Alternatively, explosive reactive armor elements (not shown) may be substituted for "bulging armor" elements 60. See U.S. Pat. No. 4,368,660 to Held, the disclosure which is hereby incorporated by reference, for a discussion of the principles of such reactive elements.

The purpose of the reactive elements is to deflect the metal plates into the trajectory of a HC jet upon impact by the jet, and thus break up and/or attenuate the jet. It is believed that the bulging occurs due to the shockwave reflections at the steel plate-rubber layer interface, as depicted by the heavy dashed lines in FIG. 3. The deflected plates act to disperse trailing portions of the jet and thus increase the chance that the remainder of the armor system can defeat the (smaller) lead portion of the jet.

Figure 3:
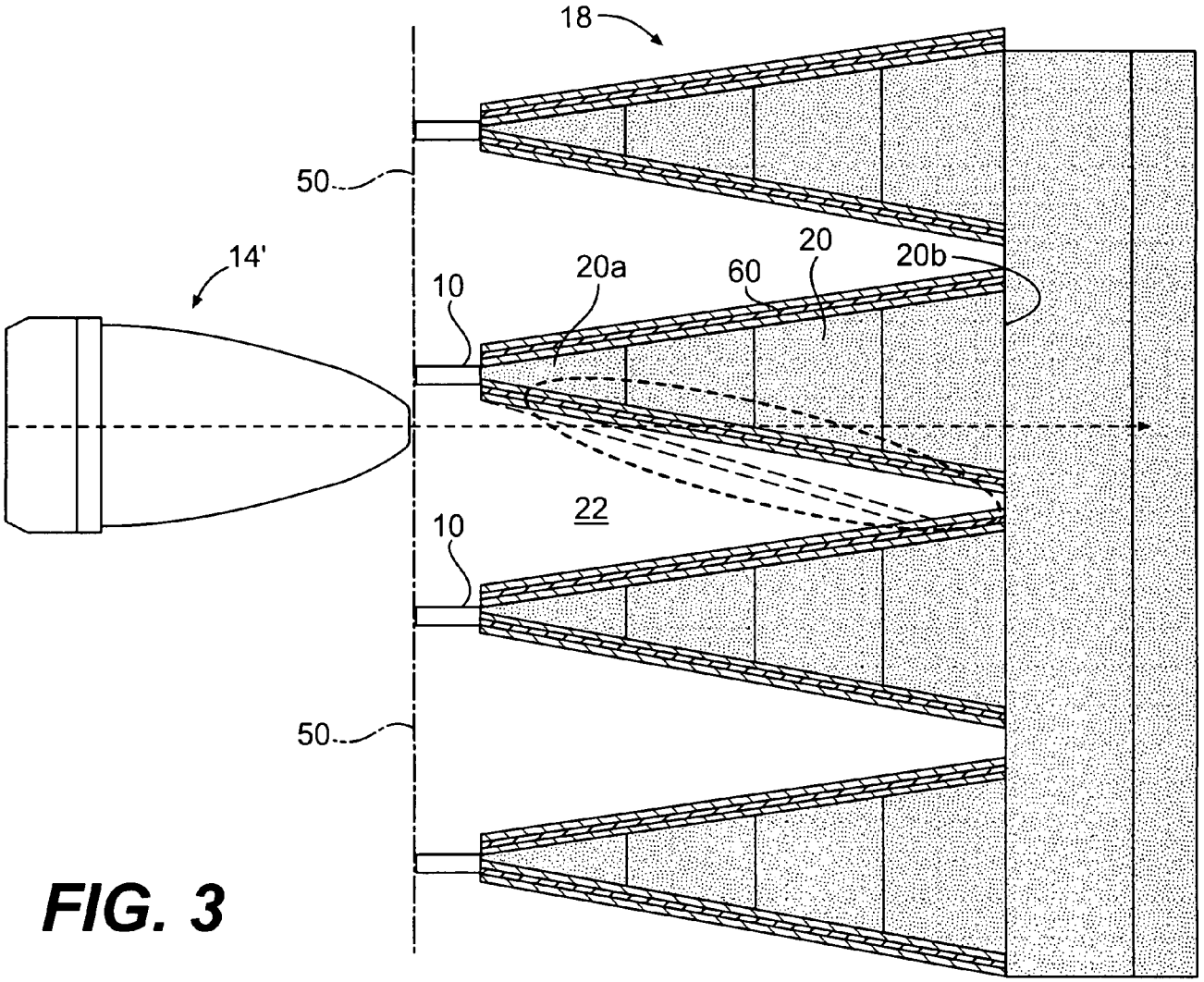
FIG. 3 is a schematic, cross-sectional view depicting performance of the armor system outer portion shown in FIG. 1, with an incident RPG warhead having a counter-measure fuze.

As one skilled in the art would appreciate, stationary HC devices would be detonated and the high speed molten metal jet formed away from the armor system, which jet would then be incident on or between the net strands of net layer 50 or the slats 10, which may have little effect in deflecting the jet from its original trajectory or attenuating the jet. Moreover, even optimum performance of net layer 50 and rigid members such as slats 10 would not disable all RPGs before detonation and jet formation. Also, the percentage of RPGs not disabled before detonation may also increase over the 30%-40% values characteristic of RPGs with piezoelectric-based fuzes, when RPGs with "countermeasure fuzes" as depicted in FIG. 3 are being used. These latter RPGs may detonate upon encountering the webbing in layer net 50 at locations offset from the slats 10 and generate a high yield jet. This jet may be deflected and/or attenuated by reactive elements 60 and then further attenuated by the fiber-reinforced material in tapered members 20. The reactive elements 60 thus provide further protection to compensate for the diminished length of fiber reinforced material at locations away from slat 10.

It may also be preferred to provide in the armor system of the present invention, one or more sheet-like layers of metal armor between the shaped layer of fiber-reinforced material and the vehicle hull, to provide increased protection against solid projectiles accompanying the HC jets, such as in hybrid shaped charges. As here embodied and depicted in FIG. 4, there is provided a layer of aluminum armor plate 32 abutting the rear surface 34 of the first layer of fiber-reinforced material sheet 30. Preferably, the aluminum plate consists essentially of an aluminum alloy having an elongation at fracture of at least 7% and more preferably 10%. Examples of preferred aluminum alloys include: 7017, 7178-T6, 7039 T-64, 7079-T6, 7075-T6 and T651, 5083-O, 5083-H113, 5050H116, and 6061-T6. It is preferred that the aluminum plate have a thickness in the range of from 8 to 40 millimeters, and in the FIG. 4 embodiment a thickness of about 25 mm may be used.

As used herein, the term armor in connection with a metal plate does not restrict the metal plate to metals and alloys that are known as armor materials. In certain applications ductile metals having high fracture toughness may be used and referred to as a "metal armor layer."

It may also be preferred to provided a steel plate between the first aluminum plate and the hull, with the steel plate abutting the rear surface of the first aluminum plate. As here embodied and depicted in FIG. 4, there is provided a layer of steel plate 36 abutting the rear surface 38 of aluminum armor plate layer 32. Preferably, the steel plate has an elongation at fracture of at least 7% and more preferably 10%. The steel can be SSAB Weldox 700; SSAB Armox 500T (products of SSAB Oxelosund of Oxelosund, Sweden); ROQ-TUF, ROQ-TUF AM700 (products of Mittal Steel, East Chicago, Ind., USA); ASTM A517; and steels that meet U.S. Military specification MIL-46100. Steels normally used for the construction of boilers like A517, A514 and other steels having similar yield strengths and elongation to break comparable to ROQ-tuf and Weldox 700 may also be used. It is preferred that the steel armor plate layer have a thickness in the range of from 5 to 20 millimeters, and in the FIG. 4 embodiment a thickness of about 10 mm may be used.

It may be further preferred to include an additional sheet-like layer of fiber-reinforced material between the steel armor layer and the hull, with the additional fiber-reinforced material layer abutting the rear surface of the steel armor layer. As here embodied and depicted in FIG. 4, there is provided a sheet-like layer 40 of fiber-reinforced material abutting steel layer 36. The sheet-like layer of fiber-reinforced material 40 may consist essentially of the same material as that used in the fiber-reinforced components 20 and 30. Whether or not the material of components 40, 20 and 30 are the same, the materials disclosed to be used in the fiber-reinforced components 20 and 30 can be used in the second sheet-like layer 40 and those materials provide similar benefits with respect to impeding projectiles and jets as are provided when used in components 20 and 30. The thickness of the fiber-reinforced material layer 40 may be about 3" in the FIG. 4 embodiment.

It may also be preferred to provide a second sheet-like layer of aluminum armor plate between the steel armor plate layer and the hull. The second sheet-like layer of aluminum plate abuts the rear surface of the additional sheet-like layer of fiber-reinforced material. As here embodied and depicted in FIG. 4, second layer 42 of aluminum armor plate abuts rear surface 44 of the additional or second layer 40 of fiber-reinforced material and also abuts the outside surface 46*a* of hull 46. Preferably, the aluminum plate consists essentially of an aluminum alloy having an elongation at fracture of at least 7% and more preferably 10% and can be a material selected from the alloys disclosed above for use in the aluminum plate 32. For the FIG. 4 embodiment, an aluminum plate thickness of about 25 mm can be used for layer 42.

Alternatively, the armor system can include, between the first sheet-like layer of aluminum armor plate and the hull, an additional or second sheet-like layer of fiber-reinforced material directly abutting the first aluminum armor plate layer, a second sheet-like layer of aluminum plate abutting the second sheet-like layer of fiber-reinforced material, a third sheet-like layer of fiber-reinforced material abutting the second aluminum armor plate layer, and a third sheet-like layer of aluminum armor plate abutting the third fiber-reinforced material layer. As embodied herein, and with reference to FIG. 5, second fiber-reinforced material layer 40 directly abuts first aluminum plate layer 32 (i.e., without a steel plate as in the FIG. 4 embodiment), followed by second aluminum armor plate layer 42, third fiber-reinforced material layer 80, and third aluminum armor plate layer 82. Aluminum plate layer 82 may directly abut hull 46 and may be formed of the same material as aluminum plate layers 32 and 42, and have similar functions. Similarly, fiber-reinforced material layer 80 may be formed of the same material as layers 30 and 40, and tapered elements 20, and have similar functions. Also, layer 80 in the FIG. 5 embodiment may be about 3" thick.

It may also be preferred that the hull of the vehicle be formed of sheet-like armor metal for each of the embodiments shown in FIGS. 4 and 5. The material used to form the hull may be at least two different sheet materials. The hull of the vehicle, a portion of which is depicted in FIG. 4 as element 46 may be formed of a tough sheet material. As used herein the word "tough" is a material that resists the propagation of a crack there though, generally referred to as a material that has a high fracture toughness. When a tough sheet material is used for the hull it is preferred to use steel known as "ROQ-tuf AM700 (a product of Mittal Steel, East Chicago, Ind.). Another material known as SSAB Weldox 700 (a product of SSAB Oxelösund of Oxelösund, Sweden) can also be used. Steels normally used for the construction of boilers like A517, A514 and other steels having similar yield strengths and elongation to break comparable to ROQ-tuf and Weldox 700 may also be used. Where the hull is to be of high strength armor plate, SSAB Armox 400 (a product of SSAB Oxelösund of Oxelösund, Sweden), or an armor meeting U.S. MIL-A-46100 can be used.

It may also be preferred to provide a third sheet-like layer of fiber-reinforced material inside the hull, to attenuate the velocity of any projectile and jet fragments penetrating the hull. As here embodied and depicted in FIG. 4, there is provided a sheet-like layer of fiber-reinforced material 48 abutting the inner surface 46*b* of the hull 46. Preferably, the sheet-like layer of fiber-reinforced material 48 may consist essentially of the same material as the material used in the fiber-reinforced components 20, 30, and 40. Whether or not the material of elements 20, 30, 40, and 42 are the same, the materials disclosed to be used in the fiber-reinforced components 20, 30, and 40 can also be used in the sheet-like layer 48. The primary purpose of the layer 48, however, is to stop or attenuate any fragments penetrating the hull so as to minimize lethality.

Also, as depicted in FIG. 4, there may be provided a rigid sheet-like layer of material consisting essentially of a high strength aramid fiber, e.g. Kevlar, in a polymer matrix abutting the rear surface of fiber-reinforced material layer 48. The rigid layer 70 forms the interior-most layer of the overall armor system of the vehicle. Like the layer 48, the purpose of layer 70 is to retain any fragments that have passed through layer 48 to minimize risk from fragments to those in the vehicle.

One skilled in the art would appreciate that the protective layers positioned adjacent the inner surface 46*b* of hull 46 in FIG. 4 could be used in conjunction with the other disclosed embodiments.

As mentioned previously, the array of slats in conventional slat armor, as depicted in FIG. 9, without a net layer can serve as the grid layer in the armor systems of the present invention. FIG. 6 depicts such an embodiment, which is similar to that of FIG. 4 (but without net 50), having essentially the same combination of sheet metal armor layers and additional fiber-reinforced material layers between the shaped layer and the hull outer surface, as well as fiber-reinforced material layers adjacent the hull inner surface. FIG. 7 depicts an embodiment also utilizing "slat armor" as the grid layer, but includes an array of spaced metal armor plates 32, 42 and 82, where the spaces between plates 32, 42 and 82 are configured as "dispersion spaces" 90, 92 and 94, as disclosed in applications of the present inventor, namely Ser. No. 11/521,307 filed Sep. 15, 2006; Ser. No. 11/713,012 filed Mar. 2, 2007, and Ser. No. 12/010,268, filed Jan. 3, 2008. The disclosures in each of these applications is hereby expressly incorporated herein by reference.

As is clear from the above discussion, the armor system of the present invention can use a grid layer of rigid members configured as elongated slats or rods, and thus be readily integrated with conventional slat armor. However, as mentioned previously, the present invention is not restricted to the use of slat or rod-type rigid members, nor is it restricted to use of a net-type grid layer with support members elongated in a direction parallel to the vehicle surface.

Figure 8:
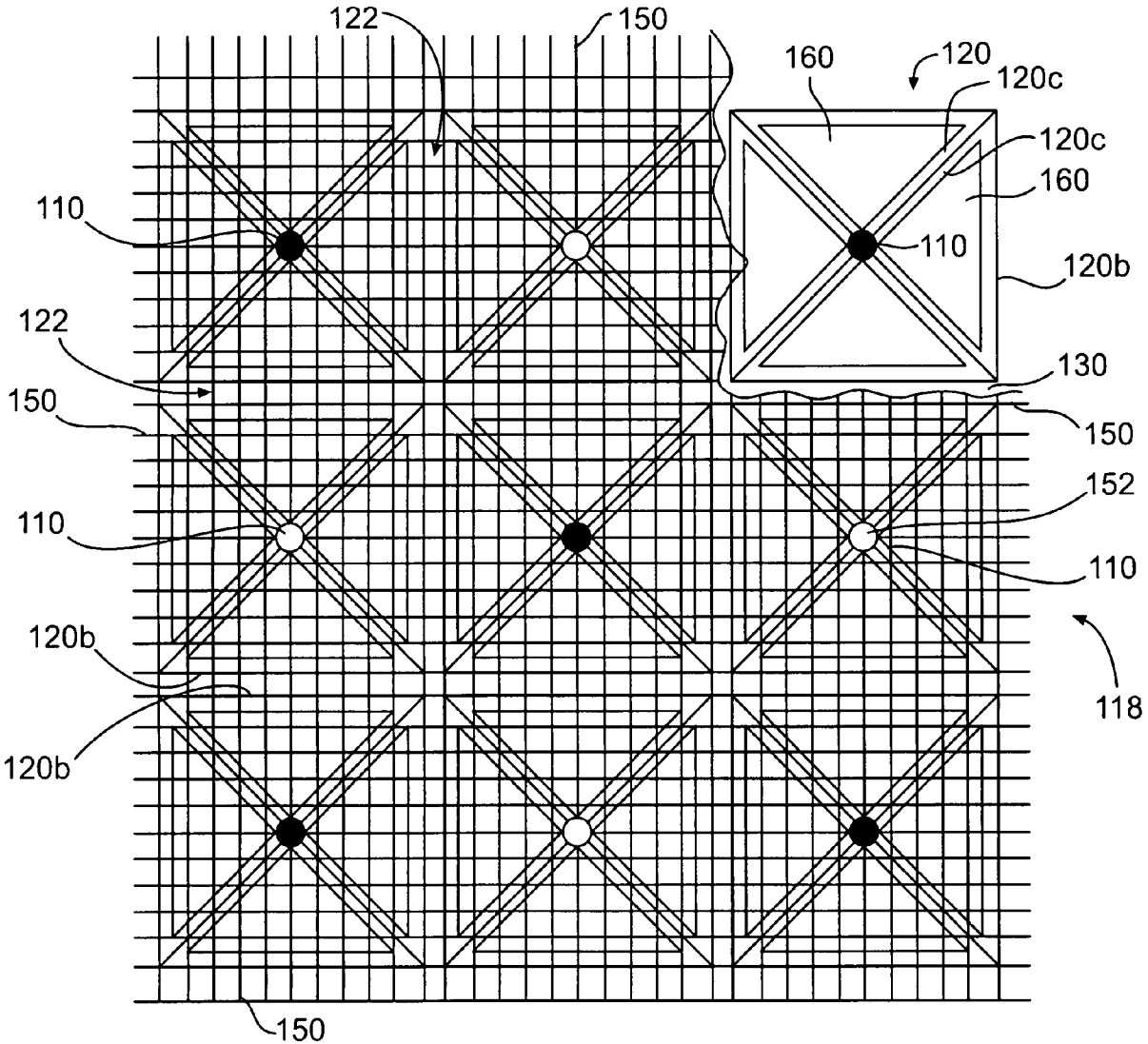
FIG. 8 is a schematic top view of an outer portion of a fifth embodiment of the disclosed armor system.

For example, FIG. 8 depicts a top view of an armor system having an array of post-like support members 110. Each post extends generally perpendicular to the vehicle hull surface, and may be mounted, such as by a threaded end post, directly to the hull or to an intermediate metal armor layer (both not depicted in FIG. 8, but see hull 46 and aluminum armor-plate layer 32 in FIGS. 4 and 5). Posts 110 may be a metal such as structural steel or aluminum and may be of a diameter sufficient to support net layer 150, which may be attached to the ends of posts 110 with mechanical fasteners (e.g. screw and washer 152), preferably removable. Although the posts 110 are shown having a round cross-section, other shapes are contemplated, as are non-metal structural post materials. Materials and mesh sizes for net layer 150 may be the same as those for net layer 50 in the embodiments shown in FIGS. 1-5, as the respective net layers have essentially the same functions.

Further provided in the FIG. 8 embodiment, is a shaped layer 118 formed from pyramid-shaped tapered members 120 constructed of a fiber-reinforced material such as the materials identified for tapered members 20 in the embodiments of FIGS. 1-5. In the FIG. 8 embodiment, each tapered member 120 surrounds a respective post 110 and has four generally planar, triangular sides extending down to a common sheet-like layer 130, which also may be formed from a fiber-reinforced material as in layers 30 of FIGS. 1-5.

As can also be appreciated from FIG. 8, the sides 120*c* of adjacent pyramid members 120 form depressions 122 for receiving the leading conical sections of RPGs. In this regard, depressions 122 can have the same depth dimension as the depth dimension of tapered member 20 in the FIG. 1-FIG. 5 embodiments. Also, the bases 120*b* of pyramid members 120 can be spaced apart a distance sufficient to accommodate an RPG fuze component.

Still further, triangular or trapezoidal-shaped bulging armor-type reactive elements 160 are disposed on the side surfaces of the pyramid-shaped tapered members 120. Reactive elements 160 may be of essentially the same construction and have the same intended function as reactive elements 60 of the embodiments depicted in FIGS. 1-5.

It is contemplated that the balance of the armor system for the FIG. 8 embodiment, that is, the portion of the armor system between the fiber-reinforced sheet 130 and the vehicle hull, would include layers corresponding to the combinations of sheet-like metal armor layers and fiber-reinforced material layers disclosed in the FIG. 4 and FIG. 5 embodiments between fiber-reinforced sheet 30 and hull 46. It is further contemplated that an overall vehicle armor system may include one or more armor layers inside the vehicle hull, such as corresponding to layers 48 and 70 disclosed in FIG. 4.

It is still further contemplated that the rigid support posts 110 need not be included in every tapered pyramid member 120. That is, if sufficient tension can be provided in net layer 150 using fewer posts 110, such as using only the middle post 110 in the top and bottom rows and the outside posts in the middle row of the 3×3 pyramid module, post ends shown darkened in FIG. 8, the chance of RPG impact and detonation on the rigid post component of the armor system may be further reduced.

It may be still further preferred to provide portions or all of the above-described armor systems as replaceable modules, to facilitate installation and repair, including field repair. For example, and with reference to FIG. 4, tapered members 20, together with the reactive elements 60, fiber-reinforced material sheet 30, and aluminum armor plate layer 32 may be configured as a replaceable module 102. Additionally, the remaining steel armor layer 36, adjacent fiber-reinforced material layer 40, and final aluminum plate layer 42 can be configured as a replaceable module 104. Each of modules 102 and 104 may be of any convenient size, e.g. 2'×2', or be sized and configured geometrically for a particular area on the vehicle hull. Other modular configurations for the Fig. embodiment would, of course, occur to the skilled artisan given the present disclosure, as well as modular configurations for the embodiments of FIGS. 1-7. For a FIG. 8 embodiment module, the rigid post elements may be included if mounted on a metal armor plate layer corresponding e.g. to metal armor plates 32, 36, or 42 in FIG. 4, depending upon the configuration of the module, as one skilled in the art would appreciate.

Finally, presently disclosed embodiments as well as the applications, namely Ser. No. 11/521,307 filed Sep. 15, 2006; Ser. No. 11/713,012 filed Mar. 2, 2007 and Ser. No. 12/010,268 filed Jan. 3, 2008, layered armor assemblies, where space allows an advantage gained by angling the armor layers with respect to the path of penetration for both HC jets and EFP penetrators, particularly for the slower velocity (e.g. below 2000 ms) penetrators.

It will be apparent to those skilled in the art that various modifications and variations can be made to the present invention. The present invention includes modifications and variations of this invention which fall within the scope of the following claims and their equivalents.

What is claimed is:

1. An armor system for defeating missile-borne and stationary shaped charges directing a high velocity jet against a vehicle, the missile having a forward conical component and a tip-mounted electric fuze, the vehicle having a hull with outer and inner surfaces, said system comprising:

a grid layer located outside and spaced away from the outer surface of the hull, said grid layer having grid members separated one from the other a distance disposed to disrupt the electrical firing mechanism of the tip-mounted fuze;

a shaped layer comprising a plurality of tapered members formed of a fiber-reinforced material between said grid layer and the outer surface of said hull, said tapered members defining depressions configured to receive a forward conical portion of an unexploded missile, and to attenuate said high velocity jet emanating from an exploding missile and/or a stationary shaped charge;

where in the armor system further includes a plurality of reactive elements disposed on outer surfaces of the tapered members and configured to deflect the high velocity jet impinged thereon by the exploding missile, and wherein the grid members include a plurality of bar or slat members, a plurality of cord members configured as a net, or combinations thereof.

2. The armor system as in claim 1, wherein the reactive elements are non-explosive bulging-type reactive elements.

3. The armor system of claim 1, wherein the shaped layer includes a sheet-like layer of fiber-reinforced material abutting base ends of the tapered members, and further including one or more sheet-like layers disposed between the shaped layer and the hull outer surface, said one or more layers including a layer of a high strength metal armor having an elongation at fracture of at least 7%.

4. The armor system of claim 3, wherein the tapered fiber-reinforced members, the fiber-reinforced sheet layer, and the high strength metal armor layer are configured as a replaceable armor module.

5. The armor system as in claim 3, wherein the one or more sheet-like layers includes two high strength metal armor layers of a material having an elongation to fracture of a least 7%, wherein the two metal armor layers are spaced apart to provide a dispersion space therebetween.

6. The armor system of claim 1, wherein the fiber-reinforced material comprises a bonded matrix of fiber in a polymer material that consists essentially of a material selected from the group consisting of: phenolic resins, epoxy resins, vinyl ester resins, polyester resins, acrylate resins, and polymethyl (meth)acrylate.

7. The armor system of claim 1, wherein the fiber in the fiber-reinforced material consists essentially of a material selected from the group consisting of: poly-paraphenylene terephthalamide, stretch-oriented high molecular weight polyethylene, stretch-oriented high molecular weight polyester, a polymer based on pyridobisimidazole, and silicate glass.

8. The armor system of claim 1, wherein the fiber-reinforced material comprises a self-bonded polymer comprised of a plurality of polymer fibers, each having an interior core of high melting point, high strength polymer and an exterior sheath of low melting point, low strength polymer.

9. The armor system of claim 8, wherein the fiber in the fiber-reinforced material consists essentially of a material selected from the group consisting of: polypropylene and polyethylene.

10. An armor system for defeating a rocket propelled grenade directed at a vehicle, the vehicle having a hull with outer and inner surfaces, the rocket propelled grenade of the type having a forward conical section and a tip-mounted electric fuze component, the system comprising:

a grid including a net layer comprising a plurality of cord members spaced from the outer surface of the vehicle by support members;

a shaped layer comprising a plurality of tapered members formed from a fiber-reinforced material, the tapered members positioned between the net layer and the hull outer surface, and having respective apex ends proximate the net layer and opposite base ends, the tapered members defining with adjacent tapered members a plurality of depressions opening in a direction away from the hull outer surface;

a plurality of bulging-type reactive elements disposed on surfaces of the tapered members defining the depressions;

wherein a mesh size of the net layer is selected to allow passage of the fuze component and to engage and deform the conical section to short-circuit the fuze component; and wherein the shaped layer includes a continuous sheet-like layer of fiber-reinforced material abutting the base ends of the tapered members.

11. The armor system as claim 10, wherein the support members are bars or slats elongated in a direction generally parallel to the hull outer surface, and wherein the apex ends of the tapered members are aligned to be adjacent respective bars or slats and are wedge-shaped.

12. The armor system as in claim 10, wherein the support members are posts oriented generally perpendicular to the vehicle hull outer surface, and wherein the tapered members are pyramid-shaped and surround respective posts.

13. The armor system as in claim 10, further including one or more metal armor layers disposed between the fiber-reinforced layer and the hull outer surface, wherein the metal is selected from aluminum alloys, titanium alloys, and steel, and has an elongation at fracture of greater than or equal to about 7%.

14. The armor system as in claim 13, having two of said metal armor layers and wherein a second fiber-reinforced layer is disposed between the two metal armor layers.

15. The armor system as in claim 13, having two of said metal armor layers and wherein said two metal armor layers are spaced apart to provide a dispersion space.

16. The armor system as in claim 10, wherein at least the tapered members, the attached reactive elements, and the fiber-reinforced layer are configured as a replaceable module.

17. The armor system of claim 10, wherein the fiber-reinforced material of the tapered members and the fiber-reinforced material layer consists essentially of a woven fabric of a high molecular weight stretch—oriented polypropylene in a low molecular weight polypropylene matrix.

18. A method of defeating missile-borne and stationary shaped charges directed at a vehicle, the missile of the type having a conical forward portion, relative to its trajectory, and a tip-mounted electric fuze component, the vehicle having a hull with an outer surface, the method comprising the steps of:

interposing a grid layer comprised of a net or spaced bar/slat array in the missile trajectory spaced from the outer surface of the vehicle hull, the grid layer having a grid mesh size to engage the conical section of the missile to short circuit the fuze for a missile not detonating on the grid layer;

interposing a shaped layer having a plurality of tapered members formed from a fiber-reinforced material between the grid layer and the hull, the shaped fiber-reinforced layer having depressions therein and bulging armor with metal plates disposed on the surfaces forming the depressions, the depressions configured such that a jet formed by a missile detonating on the grid layer next encounters the bulging armor and/or the shaped layer;

moving one or more of the metal plates of the bulging armor obliquely into the path of the jet by a reaction of the jet impinging on the bulging armor;

deflecting the jet with the metal plates moved into its path; and attenuating the deflected jet in the fiber-reinforced materials of the shaped layer.

* * * * *